US006090763A

United States Patent [19]

Stewart et al.

[11] Patent Number: 6,090,763

[45] Date of Patent: Jul. 18, 2000

[54] HYDROGEL SOAP

[76] Inventors: Howard Franklin Stewart, 4700 Moorland Dr.; Daniel Graiver, 2355 Perrine Rd., both of Midland, Mich. 48640; Robert E. Kalinowski, 4426 S. Nine Mile Rd., Auburn, Mich. 48611

[21] Appl. No.: 08/202,772

[22] Filed: Feb. 28, 1994

[51] Int. Cl.[7] ..... C11D 3/48

[52] U.S. Cl. ..... 510/130; 510/133; 510/141; 510/447; 510/450

[58] Field of Search ..... 252/90, 91, 92, 252/93, 106, 120, 123, 124, 125, 128, 130, 132, 174, 174.13, 174.23, DIG. 2, DIG. 3, DIG. 16

[56] References Cited

U.S. PATENT DOCUMENTS

| | | | |
|---|---|---|---|
| 4,062,792 | 12/1977 | McNabb | 252/91 |
| 4,155,870 | 5/1979 | Jorgensen | 252/131 |
| 4,397,754 | 8/1983 | Collishaw et al. | 252/91 |
| 4,548,983 | 10/1985 | Yokota et al. | 524/726 |
| 4,663,358 | 5/1987 | Hyon et al. | 521/64 |
| 4,802,997 | 2/1989 | Fox et al. | 252/8.6 |
| 4,844,828 | 7/1989 | Aoki | 252/90 |
| 4,851,168 | 7/1989 | Graiver et al. | 264/28 |
| 4,898,781 | 2/1990 | Onouchi et al. | 252/174.13 |
| 4,976,953 | 12/1990 | Orr et al. | 424/47 |
| 5,234,618 | 8/1993 | Kamegai et al. | 252/106 |

*Primary Examiner*—Hoa Van Le
*Attorney, Agent, or Firm*—Robert L. McKellar

[57] ABSTRACT

What is disclosed herein are new and novel hydrogel soaps and a process for obtaining them which comprises providing surface active agents in a pre-hydrogel mixture, and then forming the hydrogel. The process affords solid soaps which do not change significantly in size during use, have wide varying mechanical properties including high strengths in spite of the very high water content of the soaps, and moreover, unexpectedly provide uniform release of the surfactants and/or detergents slowly over a long period of time.

29 Claims, No Drawings

HYDROGEL SOAP

This invention deals with new and novel hydrogel soaps. This invention also deals with a process for obtaining the new and novel hydrogel soaps which comprises providing surface active agents in a pre-hydrogel mixture, and then forming the hydrogel.

This process affords solid soaps which do not change significantly in size during use, have wide varying mechanical properties including high strengths in spite of the very high water content of the soaps, and moreover, unexpectedly provide uniform release of the surfactants and/or detergents slowly over a long period of time. Furthermore, the mechanical properties of the hydrogel containing soaps thus obtained, can vary from rigid and tough to soft yet durable materials. Most significantly, these soaps are environmentally acceptable because of the fact that the larger part of the mass of the inventive soaps provided by this invention is water, which substantially reduces or eliminates the amount of undesirable organic materials, for example fatty acids, that are washed into the environment.

BACKGROUND OF THE INVENTION

Soap is one of the oldest chemicals known to man. It constitutes a significant role in the surfactant markets of the present day industry.

The manufacture of solid soaps is made up of several steps, namely, conversion of fats and oils into soap concentrates, drying of the soap and finishing of the soap in such mechanical steps as milling, plodding, addition of additives, cutting, conditioning, stamping and wrapping.

The first step of the prior art preparation is carried out either by direct saponification using the old-fashioned kettle process or by one of the newer continuous neutral fat saponification processes. The soap is prepared by the fatty acid route involving conversion of the fats into fatty acids and glycerine using a high pressure continuous fat splitting column, followed by distillation and neutralization using either Ph or viscosity controls. The choice process is a function of raw material consideration, capacity, formula variability and general economic considerations. Such soaps generally have a moisture content approaching 10 to 20 percent. The soap is then finished, which includes all the steps required to convert soap pellets into finished wrapped and packaged soap bars. Thus, it can be observed that the present methods for obtaining solid soaps is cumbersome, time consuming, and relative expensive.

PRIOR ART

The soaps of the present invention comprise as a basic component a poly(vinylalcohol) (PVA) hydrogel. Such hydrogels are known in the prior art and can be found for example in U.S. Pat. No. 4,663,358, issued May 5, 1987 to Hyon et al. This reference discloses the preparation of a porous and transparent hydrated gel that is prepared from a PVA solution in a mixed solvent consisting of water and a water-miscible organic solvent by cooling the solution below room temperature. These materials have a high tensile strength, a high water content, and a high light transmittance. This reference is incorporated herein by reference for what it teaches about the processes for obtaining PVA hydrogels.

Further disclosures for the preparation of PVA hydrogels can be found in the art, but it is believed by the inventors herein that Hyon et al represents the state of the art regarding the preparation of PVA hydrogels useful in the present invention.

Note should be made of the disclosure of U.S. Pat. No. 4,851,168 issued Jul. 25, 1989 to Graiver, et al, column 5, lines 25 and 26, wherein it is disclosed that PVA hydrogels can operate as a medium into which there is dispersed a soap or other type of detergent.

This disclosure does not teach the process of the instant invention, nor does it make obvious the instant invention as it only suggests PVA hydrogels as mediums for soaps or other type of detergents, does not provide the specificity of a process for providing such materials, and does not describe the limitations on the types of surfactants and detergents that can provide such soap materials.

THE INVENTION

This invention deals with new and novel soaps. More specifically, this invention deals with new and novel soaps which are prepared from, and are constituted of, certain PVA hydrogels. Yet another embodiment of this invention is a novel process for obtaining the soaps of this invention.

It should be noted by those skilled in the art that this invention deals with a soap which does not have the traditional fats and oils as a component and thus, the term "soap" for purposes of this invention is a material which is a cleansing and emulsifying material or article which does not contain fats and oils as a major component. Preferred are "soaps" which do not contain any fats and oils.

Thus, there is provided a method of forming a soap comprising: (I) providing an aqueous mixture of a water miscible organic solvent and poly(vinylalcohol) capable of forming a hydrogel; (II) blending a cleaning aid selected from a group consisting essentially of (i) a non-ionic surface active agent; (ii) a weakly ionic surface active agent; (iii) a non-ionic detergent; (iv) a weakly ionic detergent, and (v) mixtures of (i) to (iv), with the aqueous mixture of (I); (III) heating the blend from (II) at a temperature of from 80 to 110° C. for a time sufficient for the cleaning aid to essentially dissolve in the aqueous mixture; (IV) cooling the product of (III) until it reaches at least 0° C., whereby a soap is obtained.

The general process for providing the soaps of this invention can be found in the above-referenced Hyon et al patent, especially with regard to the detailed description set forth at column 2, beginning at about line 37, which description is incorporated herein by reference to teach the general steps of preparing a PVA hydrogel.

The process of the instant invention is a significant modification of the Hyon et al process in that during the preparation of the hydrogel, and before the cooling step found therein, there is added to the solution, a surfactant and or detergent. The surfactant and/or detergents useful in this invention are discussed in more detail infra.

Thus, the PVA as disclosed in the Hyon et al patent is prepared by dissolving PVA in a mixed solvent consisting of water and an organic solvent, followed by crystallization of the PVA at temperatures lower than room temperature.

In the process of the instant invention, the same or similar PVA is dissolved in a mixed solvent consisting of water and an organic solvent. During the formation of the PVA solution, but prior to the crystallization step,one or more surfactants and/or detergents of this invention are introduced into the solution. The modified solution is then heated to an elevated temperature to dissolve all of the ingredients to form, it is believed, a solution of surfactants and/or detergents encapsulated by the PVA hydrogel. Upon dissolution of the ingredients, this modified solution is then subjected to cooling to a temperature below 0 degrees Centigrade to form the solid soap.

The preferred temperature range for the dissolution step is about 80 to 110° C. The more preferred range is 90° C. to about 110° C. The dissolution is essentially complete when it is observed that the solution is essentially homogeneous in appearance. The amount of time required for this step can be from a few minutes to several hours, depending on the type of ingredients and the temperature allowable for the dissolution, said temperature being such that it does not destroy any of the ingredients.

The solvents useful in this process are those organic solvents that are compatible with water, or, preferably miscible with water at any mixing ratio. The recommended organic solvents include acetone, ethyl alcohol, n-propyl alcohol, iso-propyl alcohol, aminoethyl alcohol, tetrahydrofuran, dimethylformamide, glycerine, ethylene glycol, propylene glycol, triethylene glycol, and dimethyl sulfoxide, to mention a few.

No special apparatus is required to hold the PVA solution or to dissolve the surfactants and heat the mixture, and conventional chemical processing apparatus will suffice for this invention.

It should be understood by those skilled in the art that the modified solution, when cooled, can be first poured into molds, which molds can have almost any configuration desired by the preparer. For example, the soaps can be poured into standard "bar" soap form, or they can be molded into animal shapes and the like, the only limitation on shaping the solid soap being one's ability to remove the soap from the mold without breaking the soap formed therein.

Forms or shapes, for example, can be bars, liquids in the form of thick creams, mousses, sheets, composites formed from paper or cloth, flakes, pellets, sponge, foam, rods, powder, capsules, and the like. Thus, one can dip almost any material into the hydrogel/surfactant mixture before the gelling step of the process of this invention, and obtain impregnated materials. For example, one can dip natural or synthetic sponges into a hydrogel/surfactant mixture and gel the sponge and obtain an article which is a sponge filled soap of this invention. Also, one can use steel wool in the same manner to form steel wool soap pads, and woven and non-woven textile materials and paper to accomplish the same result.

Another embodiment of this invention is a process to provide for removing solvent from the soap prepared by the process set forth above. Thus, there is provided a method for forming a solvent free soap comprising: (I) providing an aqueous mixture of a water miscible organic solvent and poly(vinylalcohol) capable of forming a hydrogel; (II) blending a cleaning aid selected from a group consisting essentially of (i) a non-ionic surface active agent; (ii) a weakly ionic surface active agent; (iii) a non-ionic detergent; (iv) a weakly ionic detergent, and (v) mixtures of (i) to (iv), with the aqueous mixture of (I); (III) heating the blend from (II) at a temperature of from 80 to 110° C. for a time sufficient for the cleaning aid to essentially dissolve in the aqueous mixture; (IV) cooling the product of (III) until it reaches at least 0° C. to form a hydrogel, (V) contacting the product from (IV) with methanol to remove essentially all of the water miscible solvent from the product whereby a methanol/water miscible solvent mixture is formed, (VI) contacting the product from (V) with water to re-swell the hydrogel, and (VII) separating the hydrogel of (VI) from essentially all of the methanol/water miscible solvent to obtain essentially a solvent-free soap.

As can be noted by those skilled in the art, the essence of this embodiment of the invention are the steps (V), (VI), and (VII), in which the solvent containing soap of steps (I) to (IV) is further treated to remove the solvent from the soap.

This provides soaps that are more conducive to cosmetic applications and the like, while the soaps of the first process provide essentially industrial type soaps.

When the soap that is provided by steps (I) to (IV) is treated with methanol, the methanol essentially takes up the solvent present in the soap. Thereafter, the soap is washed with water, which removes the methanol and the solvent and also re-swells the soap by the inclusion of water.

There is also provided by this invention a composition of matter which is the soap provided by the aforementioned methods.

Thus, there is provided soaps comprising a polyvinyl alcohol hydrogel and a cleaning aid selected from a group consisting essentially of (i) a non-ionic surface active agent; (ii) a weakly ionic surface active agent; (iii) a non-ionic detergent; (iv) a weakly ionic detergent, and (v) mixtures of (i) to (iv), wherein the cleaning aid is encapsulated by the polyvinyl alcohol hydrogel to form the soaps.

Therefore it can be observed that the surfactants and/or detergents that are useful in this invention are those surfactants and/or detergents that are non-ionic or weakly ionic in nature.

Such materials for example can be the TergitolR line of non-ionic surfactants that are manufactured by Union Carbide, Danbury, Conn. Other materials useful herein are acyl isothionates, fatty alcohol sulfates, alkyl sulphosucciantes (the half or mono-ester), acyl N-methyl taurates, monoglyceride sulfates, alpha-olefin sulfonates, alpha-sulfo fatty acid esters, alkyl sulfosuccinates, amphoterics, polyalkyleneoxide glycols, and silicone polyalkyleneoxide surfactant copolymers, and the like, in addition to the fluorosurfactants manufactured by Daikin Industries and known as UnidyneR surfactants. Also useful are weakly ionic materials such as ammonium and quaternary ammonium salts.

The amount of cleaning agent that has been found useful in this invention is from 0.25 weight percent to about 10 weight percent, based on the weight of the hydrogel and cleaning agent in the soap. When a fluorosurfactant is used in the formulation, one can generally use less of the cleaning aid, for example in the 0.25 to 1 percent range, while one can use up to about 10 weight percent of cleaning aid when the surfactant is a silicone-glycol type of surfactant. Preferred for this invention is from about 0.5 to 5 weight percent of cleaning aid, and most preferred is from 1 to 3 weight percent of the cleaning aid.

It is also contemplated within the scope of this invention to add other materials to the soaps as they are being prepared. Such other adjuvants are for example fillers, moisturizers, such as aloe, glycerine and mineral oil, to name a few, and fragrances, colorants, abrasives, antimicrobial compounds such as 3,4,4'-trichlorocarbanilide (TCC), 2-hydroxy-2',4,4'-trichlorodiphenyl ether ("Irgasan" DP 300), and silane-based antimicrobial compounds such as (CH30)3Si(CH2)3N(CH3)2(C18H37) Cl, medicaments, such as benzoyl peroxide and alcohol, preservatives, and other surfactants, at least to the extent that they do not interfere with the preparation of, or the use of, the soaps of the instant invention. Also included are waxy substances which would allow for the formation of shapes and may also provide a waxy appearance and feel to the soaps, such as high molecular weight ethylene oxide polymers, or copolymers, or the like.

Finally, there is provided by this invention, certain articles which are articles treated with the hydrogel/surfactant composition of this invention, to form articles having cleaning properties.

EXAMPLES

Example 1

Preparation of a Soap of this Invention

An aqueous solution of twenty grams of polyvinyl alcohol (PVA of 86,000 Mw), 144 grams of dimethylsulfoxide, and 36 grams of water was prepared and heated under stirring at 110° C. for about 30 minutes in a glass three-necked, round bottomed flask. After the PVA was fully dissolved, twenty grams of WAQE (27% solids solution of sodium lauryl sulfate in water) was added along with 1.82 grams of limonene as a fragrance. The hot solution was stirred gently for an additional ten minutes at 110° C., and then was cast into the desired molds and placed in a freezer at −22° C. for about 16 hours. The result was a solid hydrogel. The hydrogels were placed into methanol to extract the dimethylsulfoxide and then the hydrogels were re-swollen in water. No desorption of the surfactant could be observed during this solvent exchange. The materials appeared essentially clear and were rigid. The soap had the formulation:

| INGREDIENT | GRAMS | WEIGHT % |
|---|---|---|
| water | 93.5 | 82.8 |
| PVA | 16.6 | 13.7 |
| surfactant | 5.4 | .5 |
| limonene | 1.8 | 1.5 |

Example 2

Preparation of a Soap of this Invention

An aqueous mixture of ten grams of PVA of 86,000 Mw, 84.5 grams of water, 105.5 grams of glycerol were prepared and heated to 110° under stirring in a glass three-necked, round bottomed flask for thirty minutes. The surfactant (WAQE) was then added to this hot solution under gentle stirring with care to prevent foaming, followed by the addition of 5.0 grams limonene as a fragrant. The solution was kept at 110° C. for an additional ten minutes and then was cast into the desired mold and transferred to a freezer set at −22° C. Following a short freezing cycle the molded soap bar was ready for use. A soft, yet tear resistant type of material was obtained, The final formulation had the following composition:

| INGREDIENT | GRAMS | WEIGHT % |
|---|---|---|
| water | 106.4 | 45.3 |
| PVA | 20.9 | 8.5 |
| glycerine | 105.5 | 44.9 |
| surfactant | 8.1 | 3.4 |
| limonene | 5.0 | 2.1 |

We claim:

1. A soap comprising (A) a poly(vinylalcohol) hydrogel and, (B) a cleaning aid selected from a group consisting essentially of (i) a non-ionic surface active agent;

(ii) a weakly ionic surface active agent;

(iii) a non-ionic detergent;

(iv) a weakly ionic detergent, and (v) mixtures of (i) to (iv), wherein the cleaning aid is encapsulated by the polyvinyl alcohol hydrogel to form the soap.

2. A soap as claimed in claim 1 wherein there is also present at least one adjuvant for the soap.

3. A soap as claimed in claim 2 wherein the adjuvant is an abrasive powder.

4. A soap as claimed in claim 2 wherein the adjuvant is a fragrance.

5. A soap as claimed in claim 2 wherein the adjuvant is an antimicrobial agent.

6. A soap as claimed in claim 5 wherein the antimicrobial agent is (CH3O)3Si(CH2)3N(CH3)2(C18H37) Cl—.

7. A soap as claimed in claim 2 wherein the adjuvant is a moisturizer.

8. A soap as claimed in claim 2 wherein the adjuvant is a colorant.

9. A soap as claimed in claim 2 wherein the adjuvant is a medicament.

10. A soap as claimed in claim 2 wherein the adjuvant is a preservative.

11. A soap as claimed in claim 2 wherein the adjuvant is a waxy substance at room temperature.

12. A soap as claimed in claim 11 wherein the waxy substance is a polyethylene oxide polymer which is a solid at room temperature.

13. A method of forming a soap comprising:

(I) providing an aqueous mixture of a water miscible organic solvent and polyvinyl alcohol capable of forming a hydrogel;

(II) blending a cleaning aid selected from a group consisting essentially of (i) a non-ionic surface active agent;

(ii) a weakly ionic surface active agent;

(iii) a non-ionic detergent;

(iv) a weakly ionic detergent, and (v) mixtures of (i) to (iv), with the aqueous mixture of (I);

(III) heating the blend from (II) at a temperature of from 80 to 110° C. for a time sufficient for the cleaning aid to essentially dissolve in the aqueous mixture;

(IV) cooling the product of (III) until it reaches at least 0° C., whereby a soap is obtained.

14. A method of forming a soap comprising:

(I) providing an aqueous mixture of a water miscible organic solvent and poly(vinylalcohol) capable of forming a hydrogel;

(II) blending a cleaning aid selected from a group consisting essentially of (i) a non-ionic surface active agent;

(ii) a weakly ionic surface active agent;

(iii) a non-ionic detergent;

(iv) a weakly ionic detergent, and (v) mixtures of (i) to (iv), with the aqueous mixture of (I);

(III) heating the blend from (II) at a temperature of from 80 to 110° C. for a time sufficient for the cleaning aid to essentially dissolve in the aqueous mixture;

(IV) cooling the product of (III) until it reaches at least 0° C. to form a hydrogel, (V) contacting the product from (IV) with methanol to remove essentially all of the water miscible solvent from the product whereby a methanol/water miscible solvent mixture is formed, (VI) contacting the product from (V) with water to re-equilibrate the hydrogel, and (VII) separating the hydrogel of (VI) from essentially all of the methanol/water miscible solvent to obtain essentially a solvent-free soap.

15. A method as claimed in claim 13 wherein the product of step (III) is poured into a mold prior to carrying out step (IV).

16. A method as claimed in claim 14 wherein the product of step (III) is poured into a mold prior to carrying out step (IV).

17. A method as claimed in claim 13 wherein the product of step (III) is poured unto a paper substrate prior to carrying out step (IV).

18. A method as claimed in claim 14 wherein the product of step (III) is poured unto a paper substrate prior to carrying out step (IV).

19. A method as claimed in claim 13 wherein the product of step (III) is contacted with a woven substrate and allowed to saturate said woven substrate prior to carrying out step (IV).

20. A method as claimed in claim 14 wherein the product of step (III) is contacted with a woven substrate and allowed to saturate said woven substrate prior to carrying out step (IV).

21. A method as claimed in claim 13 wherein the product of step (III) is contacted with a non-woven substrate and allowed to saturate said non-woven substrate prior to carrying out step (IV).

22. A method as claimed in claim 14 wherein the product of step (III) is contacted with a non-woven substrate and allowed to saturate said non-woven substrate prior to carrying out step (IV).

23. An article of manufacture which is a solid substrate which has been treated with a soap comprising (A) a poly(vinylalcohol) hydrogel and, (B) a cleaning aid selected from a group consisting essentially of (i) a non-ionic surface active agent;

(ii) a weakly ionic surface active agent;

(iii) a non-ionic detergent;

(iv) a weakly ionic detergent, and (v) mixtures of (i) to (iv), wherein the cleaning aid is encapsulated by the polyvinyl alcohol hydrogel to form the soap.

24. An article as claimed in claim 23 wherein the substrate is a sponge.

25. An article as claimed in claim 23 wherein the substrate is steel wool.

26. An article as claimed in claim 23 wherein the substrate is paper.

27. An article as claimed in claim 23 wherein the substrate is a textile.

28. An article as claimed in claim 23 wherein the substrate is woven.

29. An article as claimed in claim 23 wherein the substrate is non-woven.

* * * * *